US011344996B2

(12) United States Patent
Dyballa

(10) Patent No.: US 11,344,996 B2
(45) Date of Patent: May 31, 2022

(54) SURFACE CLEANING AND ENGRAVING MACHINE VIA A VACUUM BLASTING PROCESS

(71) Applicant: systeco GmbH, Berlin (DE)

(72) Inventor: Uwe Dyballa, Stahnsdorf (DE)

(73) Assignee: Systeco GmbH, Berlin (DE)

( * ) Notice: Subject to any disclaimer, the term of this patent is extended or adjusted under 35 U.S.C. 154(b) by 653 days.

(21) Appl. No.: 16/220,127

(22) Filed: Dec. 14, 2018

(65) Prior Publication Data

US 2020/0139510 A1 May 7, 2020

(30) Foreign Application Priority Data

Nov. 4, 2018 (DE) ..... 102018127450.5

(51) Int. Cl.

| | |
|---|---|
| ***B24C 3/06*** | (2006.01) |
| ***B24C 1/04*** | (2006.01) |
| ***B24C 9/00*** | (2006.01) |
| ***B08B 3/02*** | (2006.01) |
| ***B24C 3/32*** | (2006.01) |

(Continued)

(52) U.S. Cl.

CPC ..... *B24C 3/065* (2013.01); *B08B 3/024* (2013.01); *B24C 1/04* (2013.01); *B24C 3/067* (2013.01); *B24C 3/32* (2013.01); *B24C 5/04* (2013.01); *B24C 7/0053* (2013.01); *B24C 7/0069* (2013.01); *B24C 7/0092* (2013.01); *B24C 9/006* (2013.01)

(58) Field of Classification Search

CPC .. B24C 1/04; B24C 1/045; B24C 3/02; B24C 3/06; B24C 3/062; B24C 3/065; B24C 3/067; B24C 5/04; B24C 7/0046; B24C 7/0053; B24C 7/0069; B24C 7/0092; B24C 9/00; B24C 9/003; B24C 9/006

USPC ..... 451/2, 38, 39, 87, 88, 89, 100

See application file for complete search history.

(56) References Cited

U.S. PATENT DOCUMENTS

| | | | | |
|---|---|---|---|---|
| RE23,186 E * | 1/1950 | Mead | ..... | B24C 3/065 451/38 |
| 2,953,875 A * | 9/1960 | Mead | ..... | B65G 53/22 451/75 |

(Continued)

FOREIGN PATENT DOCUMENTS

| | | |
|---|---|---|
| DE | 19747838 C2 | 4/1999 |
| DE | 102017102209 A1 | 8/2018 |

*Primary Examiner* — Eileen P Morgan

(74) *Attorney, Agent, or Firm* — Michael Soderman

(57) ABSTRACT

Essential constructive elements of the currently known machines and devices, which work by means of vacuum blasting, are improved in the surface cleaning and engraving machine that operates via a vacuum jet process in order to enable more effective cleaning of different surfaces, further applications and simplification of the handling of the machine or device. With the modifications and additions made, the application options of the machine or device are increased, the potential of clogging the suction hose is reduced to a minimum, the service life of the machine is extended and the efficiency and operating options of the blasting hood are improved. For this purpose, technical and design details of an already known machine are supplemented and improved; there are, for instance, a metering device (3), additions to the blasting hood (6) and measures to extend the service life of the machine by using rock impact films (31).

9 Claims, 4 Drawing Sheets

(51) Int. Cl.
*B24C 5/04* (2006.01)
*B24C 7/00* (2006.01)

(56) References Cited

U.S. PATENT DOCUMENTS 3,073,070 A * 1/1963 Mead ..... B24C 7/0061 451/2
3,307,296 A * 3/1967 Ashworth ..... B24C 5/08 451/2
3,624,967 A * 12/1971 Compton ..... B24C 3/065 451/2
3,640,023 A * 2/1972 Field ..... B24C 9/003 451/88
3,715,838 A * 2/1973 Young ..... B43L 19/00 451/87
4,020,596 A * 5/1977 Bergh ..... B24C 3/065 451/88
4,281,485 A * 8/1981 Charity, III ..... B24C 3/06 451/29
4,984,397 A * 1/1991 Van Leeuwen ..... B24C 3/065 451/88
5,415,584 A * 5/1995 Brooke ..... B08B 7/00 134/7
5,441,443 A * 8/1995 Roberts ..... B24C 3/062 451/100
5,928,719 A * 7/1999 Mishima ..... B05D 1/12 427/180
6,200,203 B1 * 3/2001 Xu ..... B24C 1/045 451/100
6,390,898 B1 * 5/2002 Pieper ..... B24C 5/04 451/75
6,997,780 B2 * 2/2006 Pieper ..... B24C 5/04 451/38
7,040,959 B1 * 5/2006 Panuska ..... B24C 5/02 239/310
8,360,827 B1 * 1/2013 Coughtry ..... B24C 3/06 451/92
2003/0064668 A1 * 4/2003 Mrak ..... B24C 5/066 451/88
2004/0053561 A1 * 3/2004 Pieper ..... B24C 5/04 451/38
2009/0075569 A1 * 3/2009 Mase ..... B24C 7/0092 451/99
2009/0098810 A1 * 4/2009 Mase ..... B24C 9/00 451/88
2012/0015593 A1 * 1/2012 Mase ..... B24C 1/003 451/446
2016/0121456 A1 * 5/2016 Kubis ..... B24C 1/003 451/99

* cited by examiner

SURFACE CLEANING AND ENGRAVING MACHINE VIA A VACUUM BLASTING PROCESS

CROSS REFERENCE TO RELATED APPLICATIONS

This application claims the priority of DE 102018127450.5 filed on 2018 Nov. 4; this application is incorporated by reference herein in its entirety.

BACKGROUND

Surface cleaning and engraving machine by means of vacuum jet process for processing, in particular for cleaning surfaces of natural stones, tile cleaning, facade cleaning, staircase renovation, for removing paint coatings, graffiti removal, solar module cleaning and for engraving various materials, such as stone, concrete, wood, metal, plastic or glass.

DE 197 47 838 C2 describes a process and device for the dry removal of coatings, graffiti or other surfaces. A blasting medium is introduced by gravity from a storage container into a carrying air stream guided within a hose line system formed from supply and discharge lines, conveyed through this by means of vacuum, flung against the surface to be treated in a blasting chamber by a blasting lance, from there conveyed back into the carrying air stream in such a way that the blasting medium is circulated. The acceleration of the abrasive is generated by the vacuum applied to the blasting chamber and by increasing the blasting speed in an acceleration section by reducing the diameter of the supply line to the acceleration section. The vacuum supply line is connected to a straight-line acceleration pipe forming an acceleration section, which is arranged upstream of the jet lance and which has a diameter device opposite the supply line.

Furthermore, DE 10 2017 102 209 A1 describes a device for processing, in particular cleaning, abrasive removal, engraving or removal of coatings, graffiti or other surface impurities on parts, workpieces or surfaces, which, as a result of constructive improvements, enable even more effective cleaning of a wide variety of surfaces, further applications with the device and simplification of handling of the device. For this purpose, technical details of the old device were supplemented and improved, e.g. the metering device and the blasting hood.

SUMMARY

Surface cleaning and engraving machine by means of vacuum jet process for processing, in particular for cleaning surfaces of natural stones, tile cleaning, facade cleaning, staircase renovation, for removing paint coatings, graffiti removal, solar module cleaning and for engraving various materials, such as stone, concrete, wood, metal, plastic or glass.

The task of the invention is to improve essential constructive elements of the currently known machines and devices, which work by means of vacuum blasting, in order to enable more effective cleaning of different surfaces, further applications and simplification of the handling of the machine or device.

With the modifications and additions made, the application options of the machine or device are increased, the potential of clogging the suction hose is reduced to a minimum, the service life of the machine is extended and the efficiency and operating options of the blasting hood are improved.

For this purpose, technical and design details of an already known machine are supplemented and improved, e.g. a metering device (3), additions to the blasting hood (6), measures to extend the service life of the machine by using rock impact films (31).

DETAILED DESCRIPTION

The task of the invention is to improve essential constructive elements of the currently known machines and devices, which work by means of vacuum blasting, in order to enable more effective cleaning of different surfaces, further applications and simplification of the handling of the machine or device.

With the modifications and additions made, the application options of the machine or device are increased, the potential of clogging the suction hose is reduced to a minimum, the service life of the machine is extended and the efficiency and operating options of the blasting hood are improved.

The surface cleaning and engraving machine consists of three container sections, arranged above each other and connected to each other by means of metal clamps sealed air tight to each other by means of seals. A suction head with a cylindrical immersion tube and a replaceable filter cartridge for dust separation attached to it is arranged on the upper part of the container section. The suction head is also well sealed towards the upper container section and is held by metal clamps on the upper container section.

A metering device is arranged in the lower container section below a funnel-shaped storage container. This metering device consists of a metering disc with ball latches arranged offset every 45 degrees on the housing of the metering disc and corresponding balls guided in corresponding cavities on the outer edge of the metering disc, which are pressed by a compression spring towards the outer edge of the metering disc and latch into the ball latches with the corresponding rotary movement of the metering disc. Nozzles with different diameters passing through the metering disc are arranged in a circle in the middle of the metering disc. At the center of the metering disc a rod is connected vertically to it. At the free end of the rod a simple gear is arranged, which has a connecting and operating element up to the outside of the lower container section and thus enables manual adjustment of the metering disc with its nozzles to a desired flow rate for the abrasive. The desired selection and setting of the nozzle size can be carried out by means of a handwheel with nozzle size markings on the connecting and operating element outside the container section.

Only a nozzle located centrally above a passage for the air flow allows the abrasive blasting media to pass through to the passage. All other nozzles have no connection to the passage with the air flow guide. This air flow guide also belongs to the metering device underneath the dosing disc. This air flow guide pulls the abrasive blasting media in the direction of the suction hose.

This metering device can cause the blasting abrasives to accumulate in the funnel-shaped storage container. A vibration unit mounted on the outside can eliminate any possible jamming. The occurrence of a jam can be seen from the fact that no abrasive blasting media is emitted from the blasting lance. However, this solution with a vibration unit has a disadvantage in that the vibrations can spread to the entire machine. Surprisingly, it was found that by attaching a sound generator to the underside of the sieve above the storage tank with a working direction towards the metering device, a good result can be achieved in resolving clogging. A pushbutton with the electrical connections to the sound generator, which only needs to be operated when required, is recommended for this purpose. However, setting a continuous interval trigger when the machine is in operation is also conceivable.

An electrically conductive design of the extraction hose and the suction hose enables this electrical charge to be neutralized again for certain abrasives which are electrically charged by friction or when the abrasive blasting media hits the surface to be cleaned. This prevents voltage flashover. All parts, such as the housing, have electrical connections to the neutral conductor. In addition, poorly conductive areas are electrically optimized for better potential equalization by means of conductive elements. For example, the transitions of all hoses to the machine housing.

It is advantageous to arrange rock impact films on the inside of the upper container section and on the outside of the immersion tube in the areas of the impacting abrasive blasting media with the removed dirt particles. These rock impact films reduce the impact force on the corresponding surfaces.

The blasting hood also has rock impact films on metal parts frequently exposed to blasting when operating the machine.

Sliding and removable cover plates can be arranged inside or on the blasting hood. These cover plates have, for example, a rod attached to one side, which is guided in a tube. It is advantageous to move a cover plate from right to left or vice versa and/or a cover plate from bottom to top or vice versa. This allows certain areas to be covered on the surface to be processed which should not be hit by the abrasive. However, it is also possible that the cover plates are provided with recessed ornaments or letter sequences. These cover plates also have rock impact films, which have the same recesses as the underlying ornaments or letter sequences. These designs of the additional parts of the blasting hood serve as extended application of the machine, e.g. for engraving work.

The jet lance on the jet hood is advantageously guided and held by an electrically conductive rubber seal. Here similar effects are achieved as with the electrically conductive version of the extraction hose. The electrical charges generated during the removal of impurities by means of the various blasting media are discharged from the blasting hood via the hoses to the machine and then further discharged via the mains connection.

The edge of the blasting hood which rests on the surface to be processed has advantageously removable sealing rubbers with variable height and thickness. Several layers of sealing rubber can also be arranged on top of each other. Preferably these are connected to each other with Velcro. This results in areas that can be safely sealed despite different heights. This can also be done by adjusting the contact surface of the blasting hood to the surface to be processed, e.g. by adapting to curvatures, profile shapes and/or angles. The adjustment of the bearing surface does not have to be one hundred percent identical. The sealing rubbers can compensate for deviations. It is also conceivable, however, that adapters are attached to the blasting hood as an add-on component which reproduce a wide variety of shapes, such as semicircles with different radii for processing columns or posts or specially manufactured adapters for certain profiles, such as decorative strips on doors or frames. The adapters are held advantageously by bayonet locks.

Electrical lighting elements, preferably LEDs, are advantageously arranged in all four corners within the blasting hood. The LEDs radiate with their beam direction in the direction of the surface to be processed and are advantageously protected by glass panes. The result of blasting with the abrasive blasting media can thus be easily controlled by the operating personnel.

BRIEF DESCRIPTION OF THE DRAWINGS

Several examples of the invention are shown in the attached drawings and are described in more detail below. The following is shown.

DETAILED DESCRIPTION OF THE PREFERRED EMBODIMENTS

Figure 1:
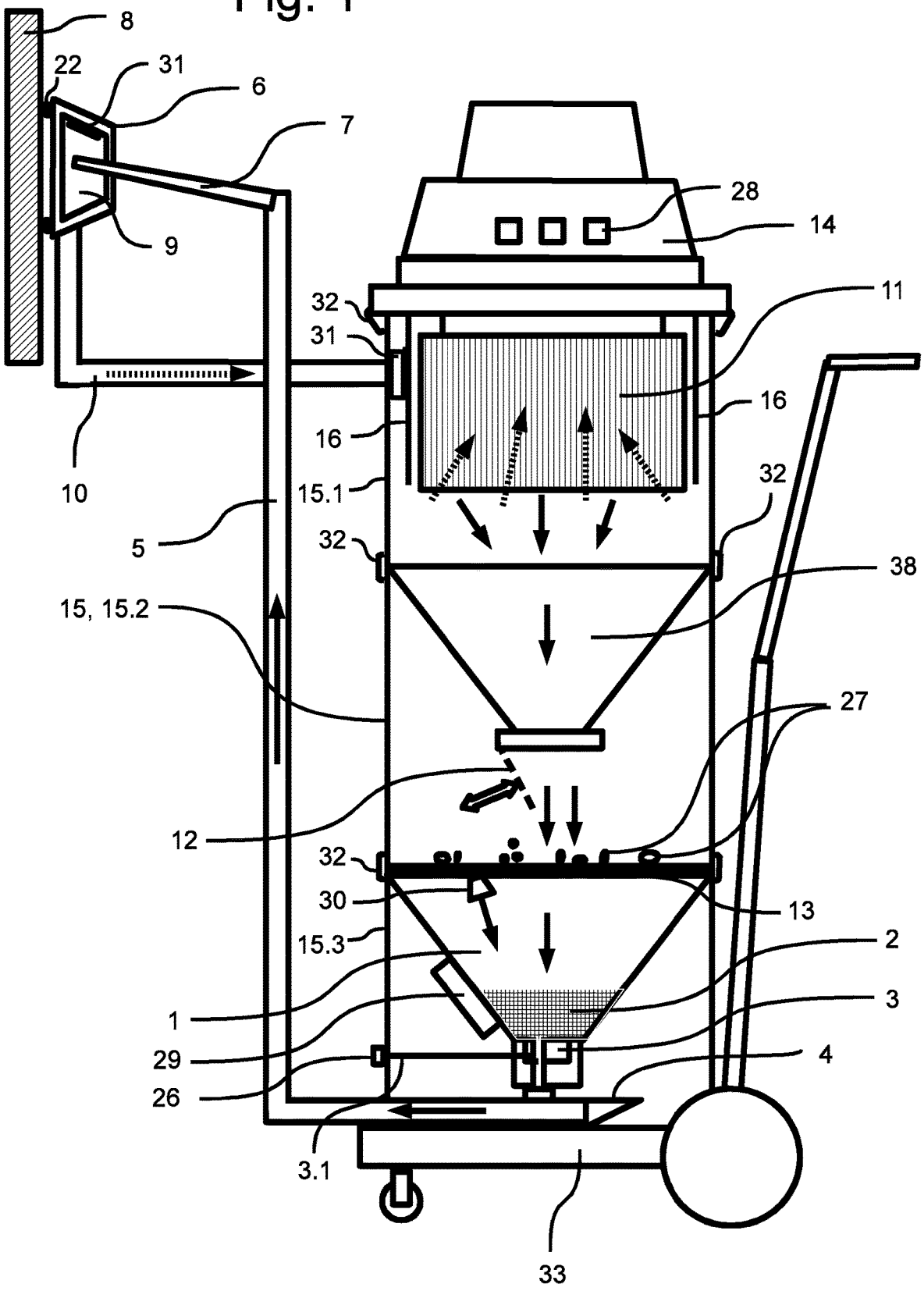
FIG. 1 a complete surface cleaning and engraving machine in the principle construction, partly in section with the principle representation of the blasting hood and the connecting hoses, FIG. 2 top view of a metering disc of the metering device, FIG. 3 the side view of a metering disc with a setting device from outside the machine, FIG. 4 a section through a blasting hood in the area of the contact surface with two sliding cover plates, FIG. 5 the detail of a blasting hood with a curved bearing surface and a recess for a strip and the corresponding sealing rubbers arranged on it, and FIG. 6 the detail of a blasting hood or an adapter with a cover surface angled at 45 degrees.
Figure 2:
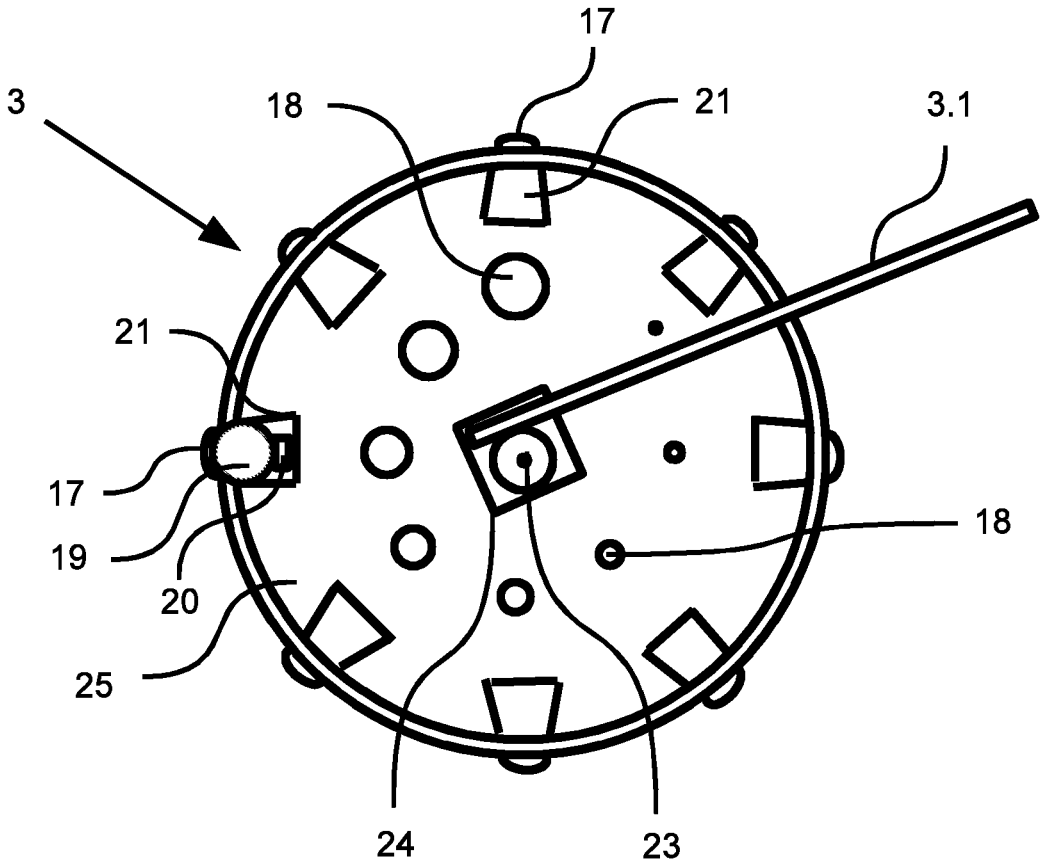
Figure 3:
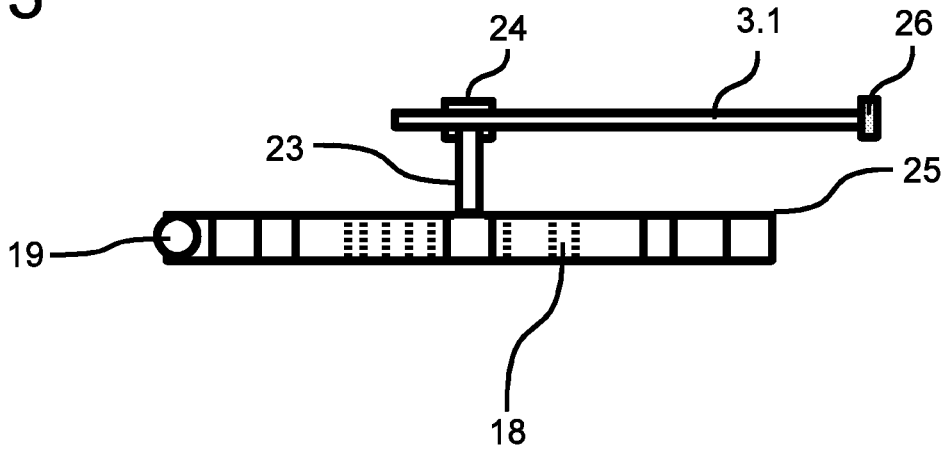
Figure 4:
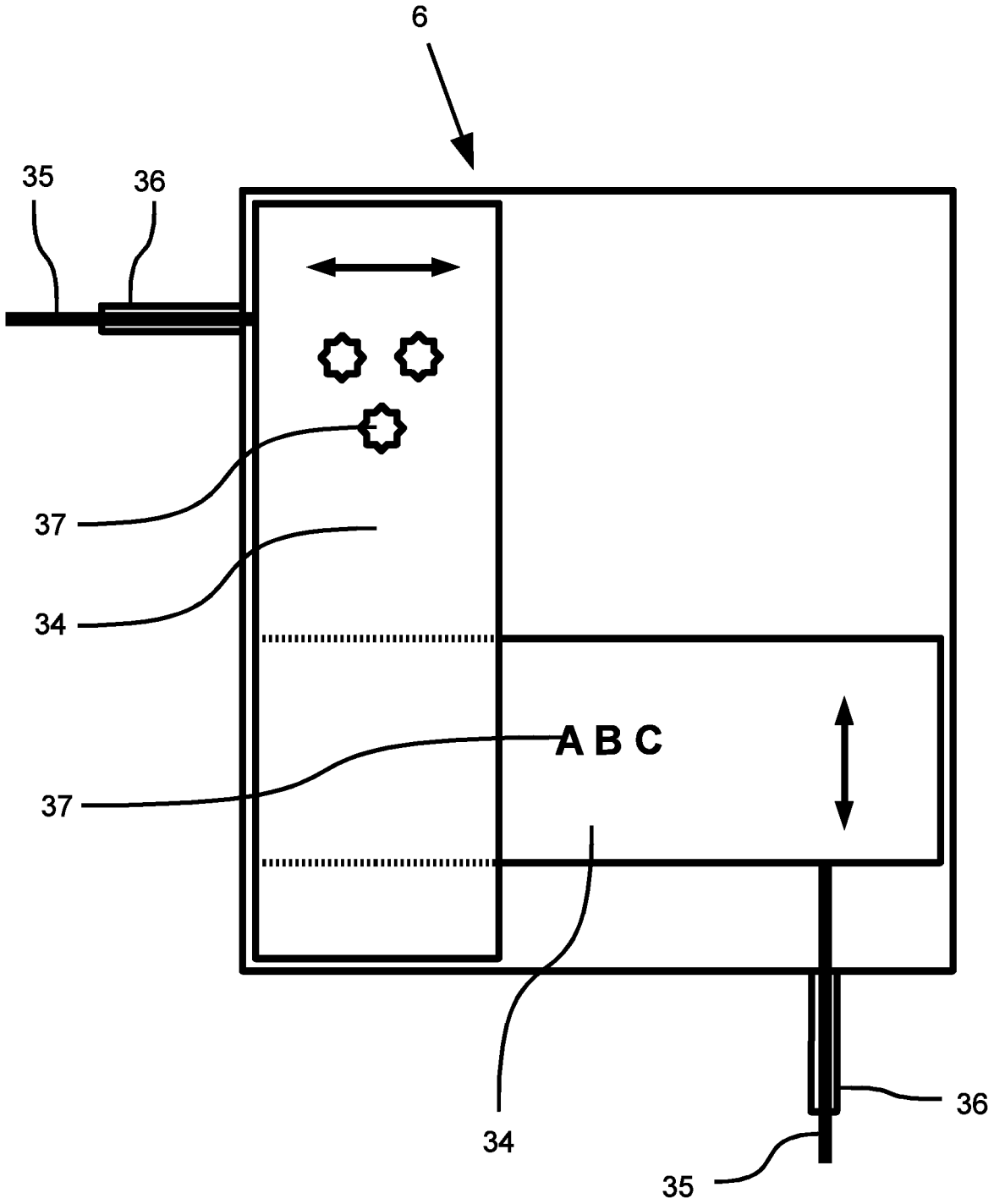
Figure 5:
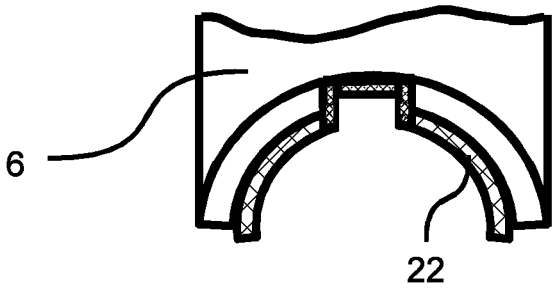
Figure 6:
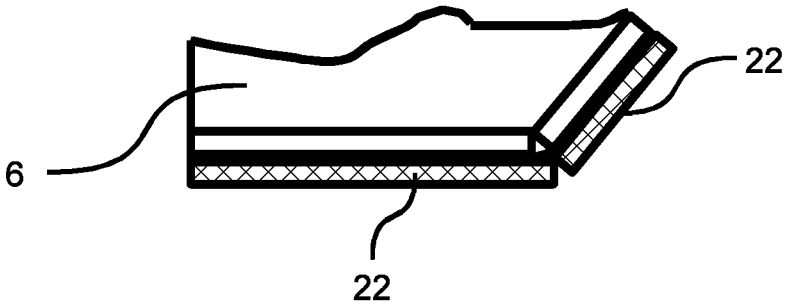

The surface cleaning and engraving machine or device is mobile and mounted on a carriage 33. The container 15 of the machine is advantageously divided into three parts and consists of an upper container section 15.1, a middle container section 15.2 and a lower part container 15.3. A suction head 14, which has a dry vacuum cleaner with fine dust filter 11, is mounted on the upper container section 15.1. The suction head 14 also has operating elements 28 and display instruments 28. All container sections 15.1 to 15.3 and the suction head 14 are connected by means of manually operated metal clamps 32 or bayonet locks 32 and can be quickly separated and reassembled for maintenance work.

In the middle container section 15.2 a feed hopper 38 is arranged, the lower outlet of which has a flap 12 and in the lower container section 15.3 a funnel-shaped storage container 1 with a dosing device 3 is arranged. In the upper container section 15.1 an extraction hose 10 is connected as a connection between a blasting hood 6 and the container 15. The dry vacuum cleaner with the fine dust filter 11 sucks the used abrasive blasting media 2, e.g. in the form of granulate 2, and the removed dirt particles 27 out of the blasting hood 6 via the extraction hose 10. The fine dust is collected at the fine dust filter 11, larger dirt particles 27 fall over the feed hopper 38 onto the sieve 13 and can be disposed of from there later. The granulate 2 can be collected in the feed hopper 38. This is done with the flap 12 closed. When flap 12 is open, granulate 2 falls over screen 13 and further down to funnel-shaped storage container 1. The use of a wide variety of blasting media 2, e.g. granulate (2) of crushed plant residues, such as nut shells, can lead to bridging in the funnel-shaped storage container 1. In order to avoid or eliminate this bridging, a vibration unit 29 is attached to the outer wall of the funnel-shaped storage container 1. In extreme cases, this vibration unit 29 can cause the entire machine to vibrate. Therefore, an alternative sound generator 30 is provided on the underside of screen 13 with a sound direction in the direction of the storage container 1 to the granulate 2. This sound generator 30 only works when an electric pushbutton 28 on suction head 14 is operated. The suction head 14 also features operating elements 28 and display instruments 28. From here, the vibration unit 29 or the sound generator 30 can also be manually switched on and off. In the event of bridge formation of the blasting agents 2, no more blasting agent 2 escapes from the blasting lance 7 of the blasting hood 6. The operator can then briefly switch on the vibration unit 29 or the sound generator 30.

The machine is electrically connected to the suction head 14. The electrical connection between the individual container sections 15.1 to 15.3 is made advantageously by means of contact pins and sockets. This allows easy separation of the individual container sections 15.1 to 15.3 as well as quick assembly. Additional markings on the container sections 15.1 to 15.3 are used for this purpose in order to securely connect the contact pins to the sockets. Inside the container sections 15.1 to 15.3 electrical cables are laid and fastened to the inner walls Below the funnel-shaped storage container 1, a metering device 3 is arranged in a circular body which is open at the top. This body, which at the same time forms the housing of the metering device 3 and comprises the dosing disc 25, has latches 17 or ball latches 17 on its inner diameter. These ball latches 17 are offset every 45 degrees on the housing of the metering disc 25. At the outer edge of the metering disc 25 there are corresponding balls 19 guided in corresponding cavities 21, which are pressed by pressure spring 20 towards the outer edge of the metering disc 25 and latch in the ball latches 17 with corresponding rotary movement of the metering disc 25. Nozzles 18 with different diameters passing through the metering disc 25 are arranged in a circle in the middle of the metering disc 25. Furthermore, at the center of the metering disc 25 a rod with gear wheel 23 is connected vertically to it. At the free end of the rod 23 a simple gear 24 is arranged, which has a connecting and operating element 3.1 as adjusting rod 3.1 up to the outside of the lower container section 15.3 and thus enables manual adjustment of the metering disc 25 with its nozzles 18 to a desired flow rate for the abrasive blasting media 2. A handwheel with nozzle size markings 26 on the outside of the lower container section 15.3 facilitates the selection and setting of the desired nozzle size. Only a nozzle 18 located centrally above a passage for the air flow allows the abrasive blasting media 2 to pass through to the passage. All other nozzles 18 have no connection to the passage with the air flow guide 4. This air flow guide 4 also belongs to the metering device 3 underneath the metering disc. This air flow guide 4 pulls the abrasive blasting media 2 in the direction of the suction hose 5.

The nozzle size then determines the quantity of abrasive blasting media 2 which later emerges from the blasting lance 7 and is available for processing the surface 8 to be processed.

The extraction hose 10 and the suction hose 5 between the blasting hood 6 and the housing 15 are advantageously electrically conductive. This allows electrically charged abrasives 2 to be discharged again.

An electrically conductive rubber seal is also advantageously provided between the blasting lance 7 and the blasting hood 6.

It is advantageous to arrange rock impact films 31 on the inside of the upper container section 15.1 and on the outside of the immersion tube 16 in the areas of the impacting abrasive blasting media 2 with the removed dirt particles 27. These rock impact films 31 reduce the impact force on the corresponding surfaces.

The blasting hood 6 also has rock impact films 31 on metal parts frequently exposed to blasting when operating the machine. This is especially the case on the opposite side to the outlet of the extraction hose 10, but without impairing the visual contact via the inspection windows 9.

Sliding and removable cover plates 34 can be arranged inside or on the blasting hood 6. These cover plates 34 have, for example, a rod 35 attached to one side, which is guided in a tube 36. It is advantageous to move a cover plate 34 from right to left or vice versa and/or a cover plate 34 from bottom to top or also vice versa. This allows certain areas to be covered on the surface 8 to be processed which should not be hit by the abrasive blasting media 2. However, it is also possible that the cover plates 34 are provided with recessed ornaments 37 or letter sequences 37. These cover plates 34 also have rock impact films 31, which have the same recesses as the underlying ornaments 37 or letter sequences 37. These designs of the additional parts of the blasting hood 6 serve as extended application of the machine, e.g. for engraving work.

The edge of the blasting hood 6 to the surface 8 to be processed is advantageously provided with removable sealing rubbers 22 made of sponge rubber with variable height, thickness and rigidity or several layers of sealing rubber 22 on top of each other. These sealing rubbers 22 are preferably connected to each other or to the blasting hood 6 by means of Velcro. The contact surface of the blasting hood 6 can be designed to the surface to be machined, e.g. with regard to curvature, profile design and angle. It is logical then that blasting hoods 6 adapted to these tasks must be used in each case. Another variant of the design is that 6 attachments can be attached to the blasting hood as adapters, which have different shapes, adapted to the shapes of the surfaces to be processed, e.g. curves, columns, angled surfaces, etc. These adapters are attached to the blasting hood by means of bayonet locks and can be quickly exchanged. They may have deviations because the sealing rubbers 22 compensate for them. This adapter variant saves costs compared to a complete exchange of the blasting hood with different shapes of the contact surface.

Electrical lighting elements, preferably LEDs, can be arranged inside the blasting hood 6 and radiate with their beam direction in the direction of the surface 8 to be processed. Due to the arrangement on four sides, there is no shadow formation by the beam lance 7. Due to the arrangement of the lighting elements close to the surface to be processed, unevenness can be better detected by the light radiating from the side. The lighting elements are advantageously protected by glass surfaces.

LIST OF REFERENCE NUMERALS

1—funnel-shaped storage container
2—blasting media, granulate
3—metering device
3.1—adjusting rod
4—air flow guide
5—suction hose
6—blasting hood
7—blasting lance
8—surface to be processed
9—viewing window
10—extraction hose
11—fine dust filter

12—closing device, flap
13—screen
14—suction head
15—container
15.1—upper container section
15.2—middle container section with feed hopper
15.3—lower container section with funnel-shaped storage container
16—immersion tube
17—ball latches, latches
18—nozzle
19—ball
20—compression spring
21—cavity for ball guide
22—sealing rubbers
23—rod with gear wheel
24—gear transmission
25—metering disc
26—handwheel with nozzle size marking
27—removed dirt particles
28—operating elements, pushbutton, display instruments
29—vibration unit
30—sound generator
31—rock impact film
32—metal clamp, bayonet lock
33—carriage
34—cover plate with recessed ornaments or letters, plate
35—rod
36—tube
37—ornaments, letter sequences
38—feed hopper

The invention claimed is:

1. A blasting machine for engraving or blasting a surface via a vacuum blasting process using an abrasive blasting media, said blasting machine comprising a container made up of three container sections including:

an upper container section, comprising a suction head with a dry vacuum cleaner, said dry vacuum cleaner having a fine dust filter, said fine dust filter surrounded by an immersion tube on the suction head, said immersion tube holding said fine dust filter and projecting into the upper container section, a middle partial container section disposed below the upper container section and comprising a feed hopper, wherein the feed hopper is located under the fine dust filter for collecting used blasting media from a blasting process and has a flap at a bottom of said feed hopper, a lower container section disposed below the middle partial container section comprising an underlying screen with an underlying funnel-shaped storage container for the blasting media, the storage container containing a vibration unit or a sound generator for avoiding accumulation of the blasting media to resolve clogging, said funnel-shaped storage container also containing a metering device with a metering disc which has a plurality of nozzles, each with different diameters, and wherein rotation of the metering disc allows any one of said nozzles to communicate with a passage to an air flow guide, the blasting machine further comprising:

a blasting hood containing a blasting lance, with one or two viewing windows, two sliding and removable cover plates to allow specific areas to be covered on the surface to be processed that are not to be hit by the blasting media and containing a hood connection for a flexible suction blasting hose and a hood connection for a flexible extraction hose, a container connection for the extraction hose on the upper container section of the three container sections of the container at a level or an area of the immersion tube containing the fine dust filter, and a container connection for the flexible suction blasting hose on the lower container section of the container below the metering device with adjoining air flow guide, wherein the air flow guide is connected to the container connection for the flexible suction blasting hose to pull, via suction, the blasting media from the metering device in the direction of the suction blasting hose, and wherein the metering disc is arranged in a body in the form of a cylindrical opening at the bottom of the lower container section, said body concurrently forms a housing of the metering device and includes the metering disc, wherein the housing contains eight ball latches on an inside wall, the ball latches are arranged offset every 45 degrees on the inside wall of the housing of the metering device and wherein the metering disc has cavities arranged correspondingly with the latches every 45 degrees on an outer edge of the metering disc and whereby balls are guided one in each corresponding cavity and the balls are pressable by means of a compression spring in the direction of the outer edge of the metering disc and wherein the balls latch in the ball latches with a corresponding rotary movement of the metering disc to align one of the metering disc nozzles with the passage to the air flow guide to obtain desired blast media flow rate.

2. The blasting machine according to claim 1, wherein the funnel-shaped storage container comprises the sound generator on the underside of the screen above and inside the storage container with a working direction towards the metering device.

3. The blasting machine according to claim 1, wherein in the center of the metering disc, a rod having a gearwheel is fixedly connected vertically to the metering disc and this gearwheel is a component of a simple gear transmission, and the gear transmission has a connecting element and operating element as an adjusting rod that extends to the outside of the lower container section of the three container sections, and a handwheel having nozzle size markings and is arranged on the adjusting rod outside the lower container section of the three container sections.

4. The blasting machine according to claim 1, wherein the suction blasting hose and the extraction hose are electrically conductive and the suction blasting hose and the extraction hose each have electrical connections to metal parts of the blasting hood, to the container and thus to a neutral conductor of the machine.

5. The blasting machine according to claim 1, wherein rock impact films are arranged on the inside of the upper container section and on the outside of the immersion tube.

6. The blasting machine according to claim 1, wherein an electrical connection between the three container sections of the container is made by means of contact pins and corresponding receiving sockets.

7. The blasting machine according to claim 1, wherein the blasting hood is covered or partially covered on the inside with rock impact films.

8. The blasting machine according to claim 1, wherein the cover plates are arranged within the blasting hood and can be moved and removed, each consisting of a plate with a rod fastened thereto on one side and guided in a tube, and the plates have recessed ornaments or letter sequences, and the plates further have rock impact films with corresponding recesses are arranged thereon.

9. The blasting machine according to claim 1, wherein the blasting hood has adapters attachable to the blasting hood as an add-on component that reproduces a wide variety of shapes with differently formed bearing surfaces for the surface to be processed with respect to curvature, profile shapes and angles, whereby the adapter can be attached leaktight to the blasting hood by means of bayonet locks, and whereby the bearing surfaces of the adapter or of the blasting hood has removable sealing rubbers with variable height, thickness and stiffness, preferably held with Velcro fastener, to the bearing surface or the blasting hood, respectively.

* * * * *